US006453828B1

(12) United States Patent
Fumanelli

(10) Patent No.: US 6,453,828 B1
(45) Date of Patent: Sep. 24, 2002

(54) SMUDGING-FLUID DISPENSING APPARATUS, FOR BANKNOTE AND VALUABLES CONTAINERS

(75) Inventor: Giuseppe Ezio Fumanelli, Melzo (IT)

(73) Assignee: M.I.B. Elettronica S.r.L., Peschiera Borromeo (IT)

( * ) Notice: Subject to any disclaimer, the term of this patent is extended or adjusted under 35 U.S.C. 154(b) by 0 days.

(21) Appl. No.: 09/595,019

(22) Filed: Jun. 16, 2000

(30) Foreign Application Priority Data

Jul. 28, 1999 (IT) ..... MI990484 U

(51) Int. Cl.[7] ..... E05G 1/14

(52) U.S. Cl. ..... 109/25; 109/29; 109/30; 109/32

(58) Field of Search ..... 109/25, 29–34

(56) References Cited

U.S. PATENT DOCUMENTS 4,018,361 A * 4/1977 Fegley ..... 109/33 X
4,799,435 A * 1/1989 Boutroy ..... 109/25
5,219,196 A * 6/1993 Luker ..... 292/207 X
5,598,793 A 2/1997 Lopez ..... 109/25
5,787,819 A * 8/1998 Fummanelli ..... 109/25 X

FOREIGN PATENT DOCUMENTS

WO WO 93/02435 A1 2/1993
WO WO 99/35622 A1 7/1999

* cited by examiner

*Primary Examiner*—Lloyd A. Gall
(74) *Attorney, Agent, or Firm*—Browdy and Neimark, P.L.L.C.

(57) ABSTRACT

There is disclosed a smudging-fluid dispensing apparatus for banknote and valuables containers internally provided with drawers (3) having predetermined work positions and extraction directions (3*a*), the apparatus comprising: a bottle (5) under pressure for the smudging fluid, channeling members (6) extending between the bottle (5) and the drawers (3) and including, at the drawers (3), movable fitting lengths (12) having hooking positions at which the drawers (3) and bottle (5) are connected with each other, electronic control and operation devices (7) for the supply of the smudging fluid, and guide elements (14) to impose to the fitting lengths (12) guide trajectories (14*a*) terminating at the hooking positions only in the presence of drawers (3) in the work positions.

14 Claims, 4 Drawing Sheets

21
1
2
19
12
15
16
4
3
19
12a
12
15
16
4
3
11
18
20
10
6
5a
9
5
7
8

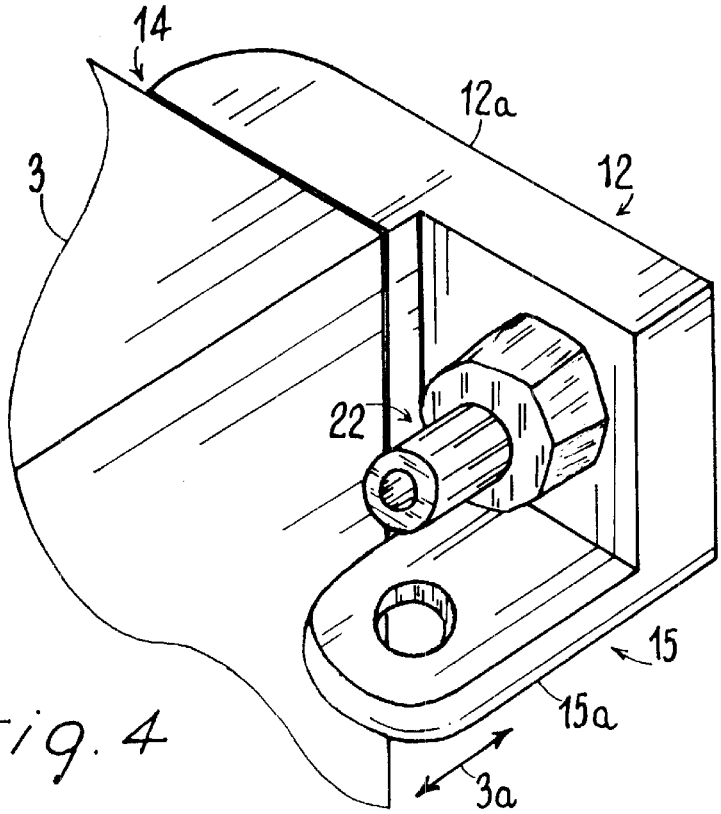
Fig. 4
Fig. 5
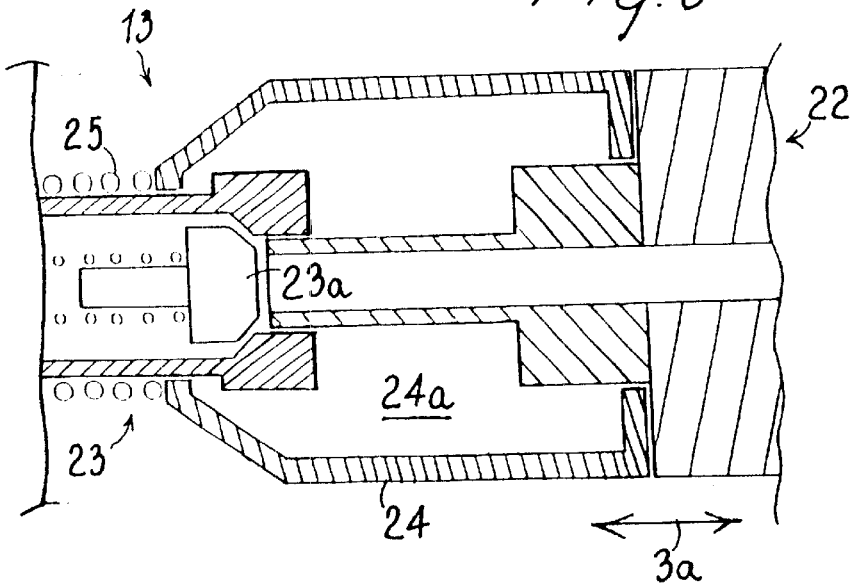

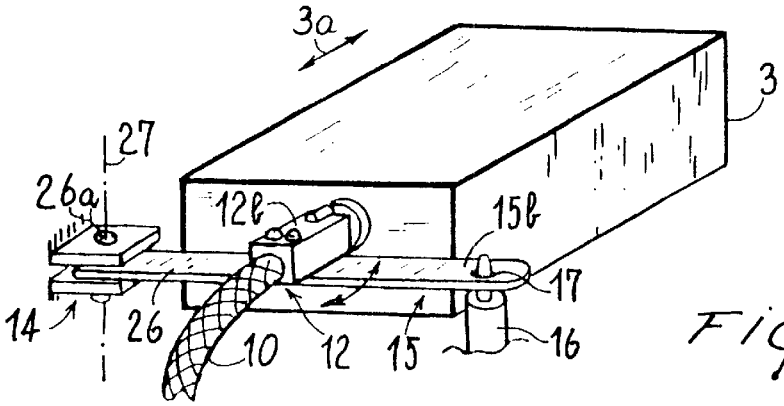
Fig. 6
Fig. 7
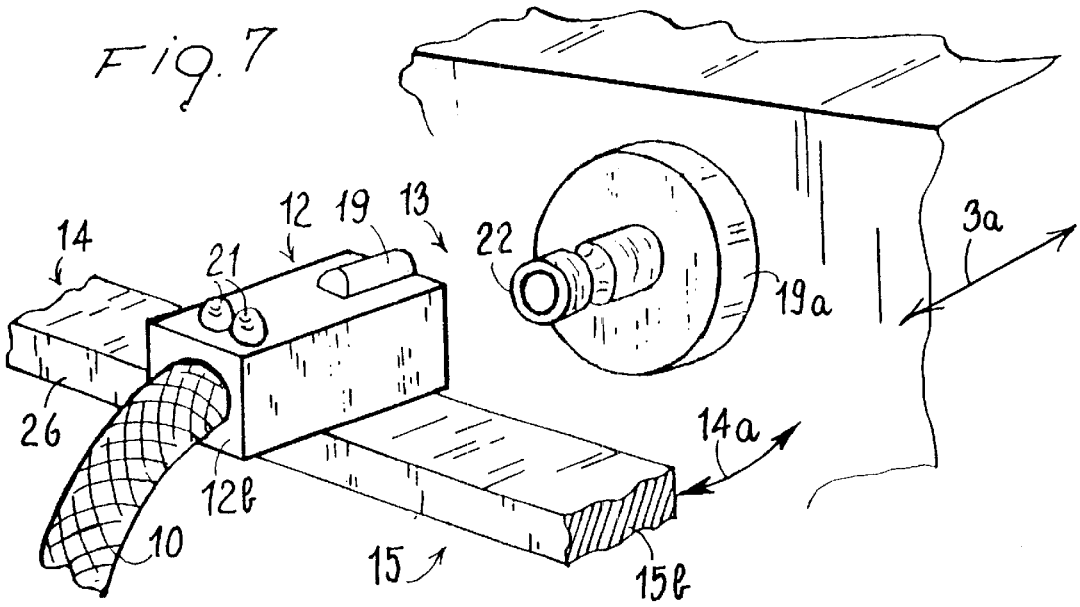

SMUDGING-FLUID DISPENSING APPARATUS, FOR BANKNOTE AND VALUABLES CONTAINERS

FIELD OF THE INVENTION

The present invention relates to a smudging-fluid dispensing apparatus for banknote and valuables containers, automatic banknote dispensers called "automatic teller machines (ATMs)" for example, or containers provided with extractable drawers or casings housing banknotes.

DESCRIPTION OF THE PRIOR ART

It is known that banknote and valuables containers, in particular automatic cash dispensers, are in many cases provided both with passive-protection devices to resist burglary attempts, and with active-protection devices, typically identified as smudging-fluid dispensing apparatus.

For instance, active-protection devices include dispenser vessels or bottles under pressure capable of delivering a smudging fluid or at all events of leaving clear and indelible traces, and fluid-channeling members from the bottles to extractable casings or drawers in which banknotes are housed.

Apparatuses in question enter into action in an efficient manner in case of an alarm or of disallowed access operations, so as to make the drawer contents unusable and discourage burglary attempts a priori.

Said apparatuses however have a drawback as they need execution of supplementary operations when drawers must be for example extracted for checking or servicing or merely for banknote supply, once said banknotes have been completely dispensed.

On these occasions the smudging-fluid channeling members must be disconnected from the drawers, following special procedures, and then connected again at the end of the overhauling or supply operations.

Since the above operations are relatively frequent, above all as far as banknote supply is concerned, and since disconnection and new connection of the channeling members must be carried out following specific and accurate modalities, it is apparent that an important slowing down in the management operations occurs, which is very unpleasant in case of automatic cash dispensers that ideally must always be in operation.

In addition, when there are operations carried out in an inaccurate manner, if the drawers are not well inserted, for example, and/or said pipes are not inserted in depth, malfunctions or prolonged stops may occur or even a non efficient fluid dispensing when pipes are not fitted in depth. This too is a very important drawback, above all for automatic cash dispensers.

Another drawback can be identified in the possibility of accidentally activating a smudging-fluid dispensing action while the pipes are disconnected from the drawers, which will bring about the risk that the smudging fluid jet, usually a liquid jet, may impinge on the staff that is carrying out the supply or servicing operations.

Smudging-fluid dispensing apparatuses also have the important drawback that they are not structurally synergetic with the passive-protection devices, because they do not exert any passive-protection function.

For instance, in automatic cash dispensers banknotes are housed in extractable drawers the extraction capability of which is not at all hindered by the apparatus spraying the smudging fluid.

Therefore, if a forced deactivation occurs, in case of burglary or lock-picking for example, and said apparatuses cannot accomplish an active protection carrying out banknote smudging, the apparatuses themselves are quite useless, since they do not cooperate in the passive protection.

Summary of the Invention

Under this situation, the technical task underlying the invention is to devise a dispensing apparatus capable of substantially obviating the above drawbacks. The technical task specified is achieved by a smudging-fluid dispensing apparatus for banknote and valuables containers internally provided with at least one extractable casing having a predetermined work position and extraction direction and comprising: at least one vessel for dispensing said fluid, channeling members extending between said dispensing vessel and said extractable casing and including, at said extractable casing, at least one movable fitting length and having a hooking position in which said extractable casing and dispensing vessel are connected with each other, electronic control and operation devices for the supply of said smudging fluid, and guide means to impose to said fitting length a guide trajectory terminating at said hooking position only in the presence of said extractable casing in said work position.

BRIEF DESCRIPTION OF THE DRAWINGS

Description of an apparatus in accordance with the invention is now given hereinafter, by way of non-limiting example, with reference to the accompanying drawings, in which:

FIG. 4 is a perspective view of an element of the apparatus shown in FIG. 3, in an isolated position;

FIG. 5 shows a detail of the apparatus to an enlarged scale and in section;

FIG. 6 is a perspective view of a banknote drawer in an isolated position and of some elements of a further embodiment of the apparatus in accordance with the invention, in an engagement position; and FIG. 7 shows some elements of FIG. 6 to an enlarged scale and in a disengagement position.

DESCRIPTION OF THE PREFERRED EMBODIMENTS

Figure 1:
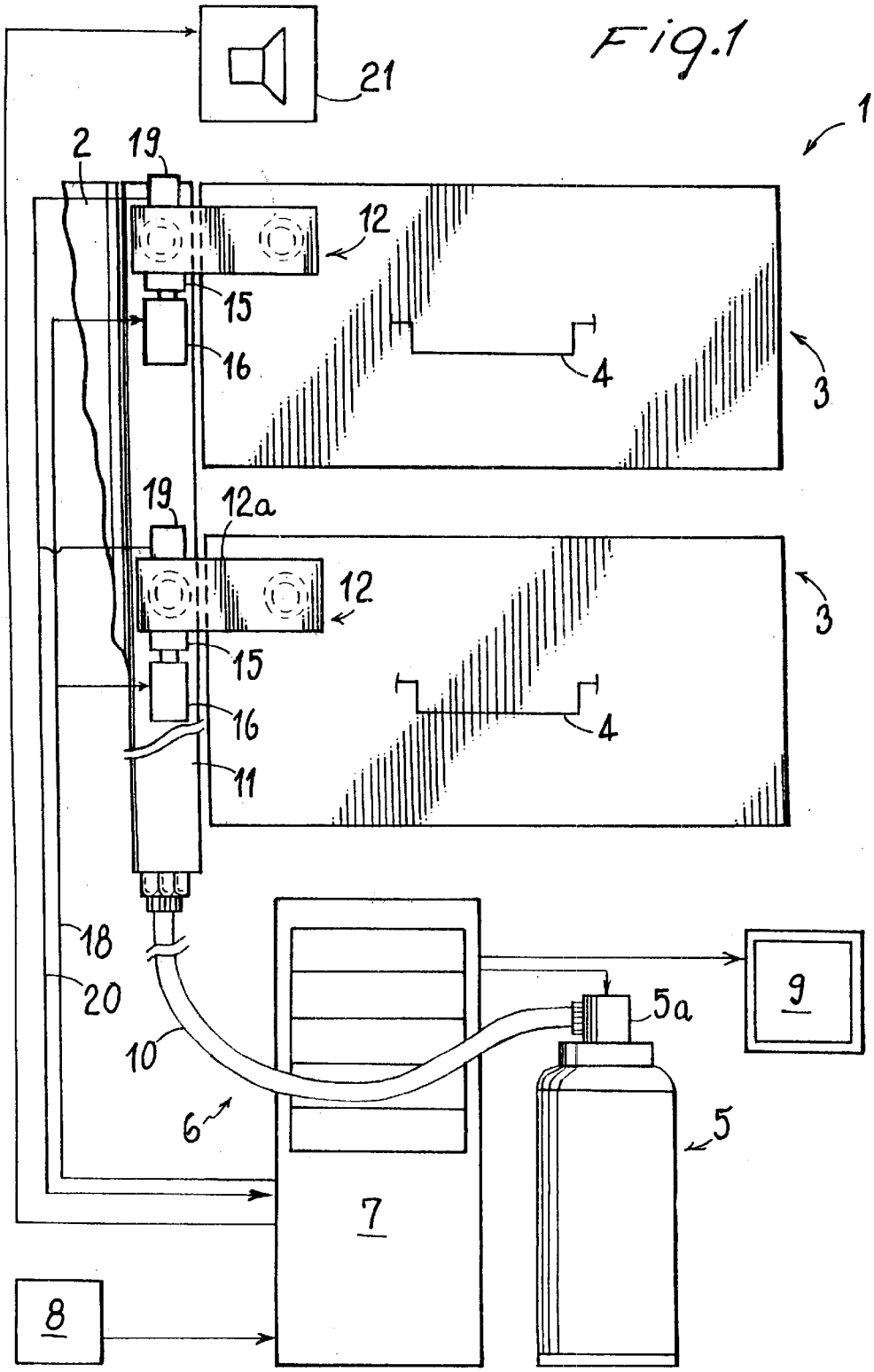
FIG. 1 is a diagrammatic view of the elements forming the apparatus of the invention, correlated with two banknote drawers.

With reference to the drawings, the smudging-fluid dispensing apparatus is generally identified by reference numeral 1.

It is in particular intended for automatic cash dispensers known as "automatic teller machines (ATMs)".

Such dispensers, in known manner, have an outer body with fixed walls provided with a light armor-plating. In FIG. 1 one of these walls is diagrammatically denoted at 2.

Housed within the dispenser is at least one extractable casing or drawer 3 within which the banknotes to be supplied, upon request, to the dispenser's users are usually disposed.

Figure 2:
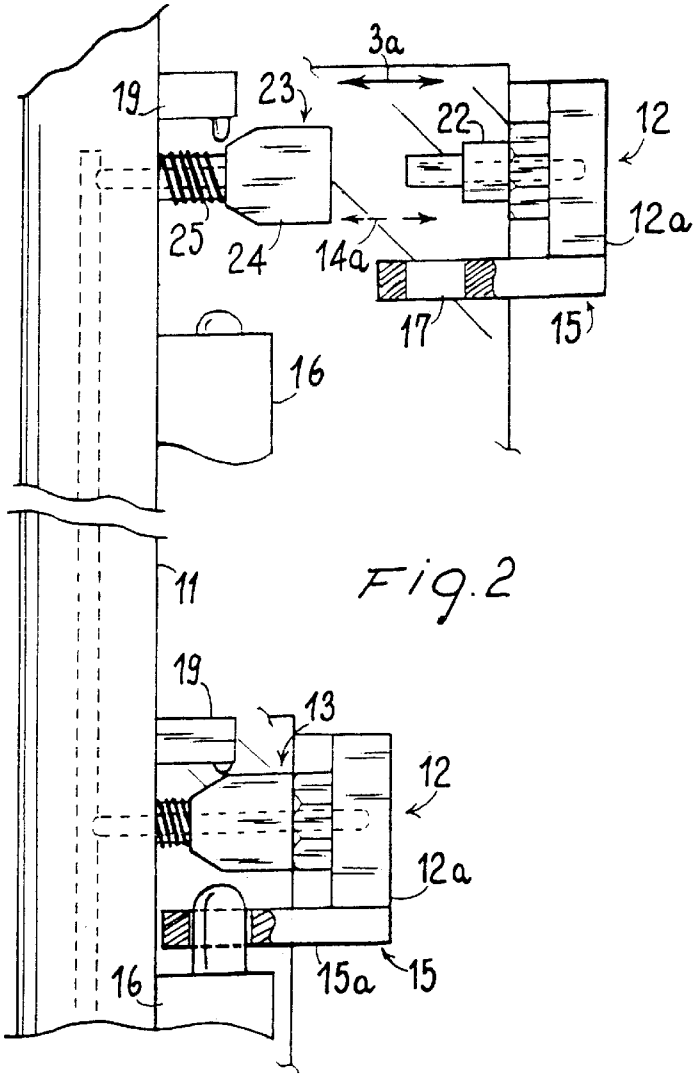
FIG. 2 is a side view of a portion of the apparatus, at the banknote drawers, with the respective elements at two different, i.e. engagement and disengagement, positions.

Two extractable casings or drawers 3 are shown by way of example in FIGS. 1 and 2.

Supply and count of the banknotes coming out of drawers 3 takes place through devices known per se that are not part of the invention.

Drawers 3 are housed in appropriate seatings of the dispenser. The position of complete insertion into these seatings which is coincident with the position for carrying out the operations for banknote supply to users, is the work position of drawers 3.

The dispenser also has one or more doors for access to the inside thereof, in particular in order to enable execution of the different servicing operations and above all the periodical banknote supplies to drawers 3.

During servicing or banknote supply, drawers 3, optionally provided with a handle 4, are pulled out of their work position using a predetermined extraction direction, identified by 3*a*.

Apparatus 1 comprises at least one dispensing vessel for the smudging fluid consisting of a liquid that can be atomized and is capable of leaving clear and indelible traces or marks.

In the drawings a single dispensing vessel is shown and it is defined by a bottle 5 under pressure provided at the top with a value or a solenoid valve 5*a*.

Also provided are channeling members 6 extending between the valve 5*a* and drawers 3.

Electronic control and operation devices 7, diagrammatically embodied in FIG. 1 by a computer, receive signals in known manner from various detecting devices and sensors, diagrammatically identified by 8, said devices or sensors for example detecting either opening or forcing or damaging of the dispenser walls 2.

The electronic control and operation devices 7 also oversee dispensing of the smudging fluid, through operation of valve 5*a* for example, and switching on of alarm devices 9 known per se.

The channeling members 6 extend from valve 5*a* through at least one piping that can fully or partly be a movable hose 10 of the flexible type, and/or a fixed pipe 11 of the rigid type.

The channeling members 6 also have, at each drawer 3, at least one fitting length 12 which is rigid and movable and has a hooking position, corresponding to an operating position, in which drawers 3 and bottle 5 are operatively connected with each other.

In other words, each fitting length 12 is movable towards and from a hooking position at which the smudging fluid can possibly reach the space at the inside of drawers 3.

From the fitting lengths 12 the smudging fluid directly enters the space within drawers 3, or it is distributed in said inner space by means of perforated tubular diffusers extending in the form of a pipe coil on the inner upper wall of drawers 3. In said hooking or operating position a steady engagement without leaks of the fitting lengths 12 is ensured by couplers 13 placed at the fitting lengths which are of the male-female type for example, as better pointed out in the following.

For reaching said hooking position, guide means 14 is provided which is rigid with the fitting lengths 12 and capable of imposing to the latter a predetermined guide trajectory 14*a* that at least at the end coincides with the extraction direction 3*a* of drawers 3 and enables the hooking position to be reached only when drawers 3 are in their work position.

According to a further aspect of the invention, a passive-protection device integrated with the dispensing apparatus I is arranged.

In fact, locking means 16 is provided which is supported in a rigid manner by fixed portions of the automatic dispenser and is adapted to fasten the fitting lengths 12 to their hooking position, in order to prevent both extraction of the fitting lengths 12 from the hooking position and extraction of drawers 3 from the work position.

In fact, advantageously the locking means 16 acts on the fitting lengths 12 in such a manner that it simultaneously locks drawers 3 too.

In addition and preferably, the locking means 16 acts on the fitting lengths 12 at a tailpiece 15 of said lengths.

This tailpiece 15 has at least one seating or hole 17 for coupling with the locking means 16 and is engaged by said means when the fitting lengths 12 are in their hooking position.

The locking means 16 may be either of the electromechanical type, or merely of the mechanical type, or in the form of a lock, a padlock or others. In the figures the locking means 16 is embodied by electromechanical cylinders having a rod insertable upon command into hole 17.

The operation command for the cylinders is generated by the electronic control and operation devices 7 through an electric connection 18.

Advantageously provided are sensors 19 adapted to detect the correct mutual engagement of couplers 13 and therefore the correct insertion position of drawers 3 too, and capable of sending corresponding operating signals 20 to the electronic control and operation devices 7.

Use of sensors 19 capable of recognizing insertion of the drawers can be very advantageous. In this manner mistakes or incorrect operations that could impair the dispenser functional character or safety are avoided.

Through the electronic control and operation devices 7, sensors 19 are also connected with members signaling the operating conditions of the automatic dispensers, in particular with one or more warning indicators 21.

In the embodiment shown in FIGS. 1 to 5, the channeling members 6 comprise a fixed pipe 11 extending vertically alongside drawers 3 and being fixed and rigid with a wall 2.

Each fitting length 12 appears like an expansion 12*a* of a respective drawer 3 and is movable therewith.

The guide means 14 of the fitting lengths 12 is embodied by the drawers 3 themselves with which expansions 12*a* are rigidly connected.

Therefore the extraction direction 3*a* and guide trajectory 14*a* are substantially coincident and the work and hooking positions can be only simultaneously reached.

Still in FIGS. 1 to 5, expansions 12*a* extend laterally of drawers 3 as far as they project therefrom on the side where the fixed pipe 11 is located.

Couplers 13 are arranged between the fixed pipe 11 and each expansion 12*a*. The mutual engagement position of couplers 13 is shown in solid lines in FIG. 3 and in the lower part of FIG. 2, where drawers 3 are in a work position.

In detail, it is to be noted that couplers 13 comprise male couplers 22 in engagement with expansions 12*a* and female couplers 23 in engagement with the fixed pipe 11.

The female couplers 23 advantageously contain a valve element 23*a* inhibiting the smudging fluid flow when the male coupler 22 is not fitted.

Figure 3:
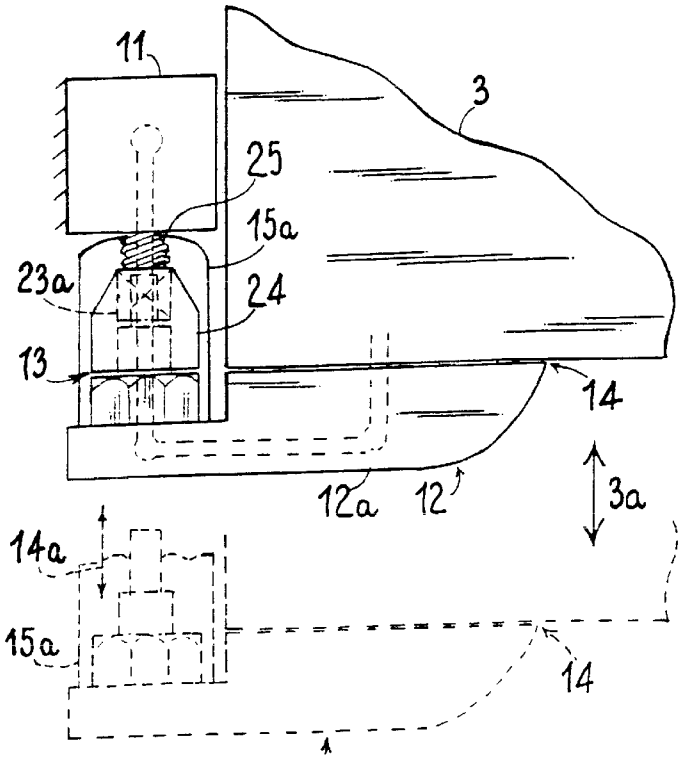
FIG. 3 is a plan view of the end portion of the apparatus shown in FIG. 2 and highlights a portion of the apparatus and of a banknote drawer in a pushed-in position in solid lines and in a pulled-out position in chain lines.

The valve element 23*a* is diagrammatically shown in FIGS. 3 and 5 and can be of the mechanical type, for example of a type, known per se, stopping outflow of air from tires.

The valve element 23*a* is in a relatively forward position, so that it can be deactivated in a priority manner to enable free passage of the smudging fluid, if said fluid is dispensed from bottle 5, as soon as the male couplers 22 are fitted.

In addition, each female coupler 23 is externally provided with a sleeve 24 forming a holding chamber 24*a* adapted to keep compactness of the smudging fluid jet possibly dispensed when coupler 22 is fitted in an inaccurate manner. Sleeve 24 is maintained in a projecting and forward position with respect to the fixed pipe 11 by the action of spring means 25.

In particular, sleeve 24 is provided to keep a forward position to an extent sufficient to establish a contact with the respective fitting length 12 or a male coupler 22, as soon as the valve element 23*a* is opened.

In FIGS. 1 and 2 sensors 19 are electromechanical microswitches responsive to the sleeve position. It is however apparent that sensors 19 can be of various types, magnetic or optical sensors for example.

Tailpiece 15, provided for a passive protection too, is a tab extension 15*a* of the fitting lengths 12 projecting in the direction of the fixed pipe 11, for example. The tab extension 15*a* can however follow any suitable direction.

The locking means 16 for example defined by said electromechanical cylinders, can be fastened to the fixed pipe 11 or the adjacent wall 2 of the automatic dispenser, as well as to any suitable position.

In the further embodiment of the dispensing apparatus 1 shown in FIGS. 6 and 7, the channeling members 6 comprise a movable pipe 10 and, at the end thereof, fitting lengths 12 defined by blocks 12*b* movable in front of drawers 3. Therefore blocks 12*b* are movable independently of drawers 3.

The guide means 14 overseeing movements of blocks 12*b* are embodied by at least one bar 26 provided with a first end connected with an articulated joint 26*a*.

Each fitting length 12 or block 12*b* is rigidly connected to bar 26 and the articulated joint 26*a* is formed for example at a wall 2 of the dispenser.

The articulated joint 26*a* defines both the bar 26 trajectory and the trajectory of the fitting length 12, rigidly connected with bar 26.

In detail, the articulated joint 26*a* defines a vertically-directed rotation axis 27 so that each fitting length 12 can carry out a translation along a guide trajectory 14*a* defined by a wide arc of a circumference extending in front of each drawer 3 at a work position and at the end substantially coinciding with the extraction direction 3*a,* as shown in FIG. 7.

In FIGS. 6 and 7 couplers 13 comprise a male coupler in engagement with drawers 3 and a female coupler formed in blocks 12*b*.

Sensors 19, adapted to detect the correct position of blocks 12*b* relative to the adjacent drawers 3, are then put directly in rigid connection with the blocks 12*b* themselves.

It is to be noted that each sensor 19 preferably consists of a magnetic field sensor responsive to the distance from a magnetic locator 19*a* surrounding the male coupler like a disk.

Connected with sensors 19 in the embodiment shown in FIGS. 6 and 7 are signaling members or warning indicators 21 informing about an insufficient insertion or lack of insertion/hooking of drawers 3, said indicators being directly placed on each block 12*b* and consisting of a green LED (Light-Emitting Diode) to highlight a correct hooking situation and a red LED to highlight a wrong situation or an alarm.

Tailpiece 15 for active protection is a crosspiece extension 15*b* of bar 26 extending beyond block 12*b* and terminating with an end portion having at least one hole 17 to be engaged by the locking means 16 supported by a wall 2 for example, and embodied by electromechanical cylinders provided with a rod insertable upon command into hole 17.

Operation of apparatus 1 is as follows.

The apparatus first of all ensures an active protection to the banknotes or valuables housed in drawers 3: in case of alarm it dispenses a fluid on said banknotes and valuables which is capable of leaving clear and indelible traces. In accordance with the invention, the correct and real functional character of the apparatus is ensured through control of the correct insertion and positioning of the channeling members 6 and drawers 3.

In fact, sensors 19 detect and signal every insufficient insertion of the fitting lengths 12. In addition, in no case a complete insertion of the fitting lengths 12 is made possible if drawers 3 are not well positioned: in the case shown in FIG. 2 because the two operations are simultaneous, in the case shown in FIG. 7 because if the drawers are not thoroughly inserted in the work position the guide trajectory 14*a* is transverse to the male element 15.

It should be also recognized that a precise and thorough insertion of the fitting lengths 12 is made easy and immediate by the guide means 14.

In the embodiment where the fitting lengths 12 are made up of expansions 12*a,* drawers 3 themselves form the guide means and determine positioning of the expansions 12*a,* whereas in the embodiment where the fitting lengths 12 are made up of blocks 12*b,* positioning is determined by the accurate rotation of a bar 26 around an articulated joint 26*a*.

If sensors 19 detect the presence of errors, said errors are signaled by the warning indicators 21.

If intervention of the warning indicators 21 does not obtain restoration of a correct situation, the alarm device 9 can be switched on.

The detailed structure in FIG. 5 is a further assurance on the safety and functional character of the apparatus since, after switching on of the alarm device 9, also activation of the smudging-fluid dispenser is enabled in spite of the presence of insertion errors.

In fact, while drawers 3 are moved to closure, the valve elements 23*a* are opened in a priority manner so that passage of the smudging fluid is enabled even if the male elements 22 are not perfectly inserted in depth.

Simultaneously with the priority opening of the valve elements 23*a,* the male elements 22 engage sleeve 24, against the action of the spring means 25.

Therefore, even if the connecting elements 13 are only disposed close to each other, sleeves 24 embody holding chambers 24*a* for the jet that are sufficient to cause the fluid to flow into the fitting length 12—and into drawers 3—without leaks in the surrounding environment.

Then the valve element 23*a* is capable of preventing fluid flows when the drawers are completely pulled out, so that damages to the staff are avoided, should the smudging fluid be accidentally dispensed while drawers 3 are pulled out.

Apparatus 1 also has a passive safety function, because the locking means 16 prevents extraction of drawers 3 in the absence of special procedures or conditions for deactivating the locking means 16.

This passive protection is efficient because each drawer 3 has its own locking means. Therefore in case of burglary a prolonged work is required for deactivating all the locking means. Thus there is a delay in burglary that can lead to abandonment or failure of same.

The invention achieves important advantages.

The devised apparatus is capable of both making the operators' procedures greatly simpler and increasing the banknote and valuables containers' safety, in particular in case of automatic cash dispensers.

The channeling members are in fact connected and disconnected in an automatic and easier manner that however does not enable connection of said channeling members if the drawers are not in the correct work position.

In addition, the position of correct and complete introduction of the drawers and the hooking position of the channeling members are controlled and signaled.

Furthermore, under alarm situations intervention of the dispensing apparatus is made possible even when the latter is not in its optimal conditions. This is accomplished without making possible, but on the contrary hindering, accidental switching on of the apparatus when the drawers are pulled out.

Also of importance is the fact that the apparatus is also efficient as a passive protection and therefore maintains its utility in case of burglary even if the members conveying the smudging fluid are not activated.

What is claimed is:

1. An apparatus for dispensing smudging fluid in a banknote and valuables container internally including at least one extractable casing (3) having a predetermined work position and extraction direction **(3*a*)**, the apparatus comprising:

at least one dispensing vessel (5) for said fluid;

channeling members (6) arranged between said at least one dispensing vessel (5) and said at least one extractable casing (3);

electronic control and operation means (7) for controllably supplying said smudging fluid from said at least one dispensing vessel (5) to said at least one extractable casing (3) in case of unauthorized access to said at least one extractable casing (3) in said work position;

wherein said channeling members (6) comprise:

at least one fixed pipe (11) arranged adjacent to said at least one extractable casing (3) sideways thereof and in fluid flow communication with said at least one dispensing vessel (5);

at least one fitting length (12) rigid with said at least one extractable casing (3) and projecting laterally from said at least one extractable casing (3) at a side thereof where said at least one fixed pipe (11) is arranged;

at least one coupling means (13) between said at least one fitting length (12) and said at least one fixed pipe (11), said at least one coupling means (13) comprising a first coupling element (22) carried by said at least one fitting length (12) and in fluid flow communication with said at least one extractable casing (3), and a second coupling element (23) carried by said at least one fixed pipe (11) and in fluid flow communication with said at least one fixed pipe (11);

said first and second coupling elements (22, 23) extending in said extraction direction **(3*a*) sideways of said at least one extractable casing (3) and being movable between an engagement position and a disengagement position, whereby removal of said at least one extractable casing (3) from said work position causes mutual disengagement of said coupling elements (22, 23) and positioning of said at least one extractable casing (3) into said work position causes mutual engagement of said coupling elements (22, 23)**;

and further comprising:

at least one sensor means (19) for detecting said engagement position of said coupling elements (22, 23), said sensor means (19) being operatively connected with said electronic control and operation means (7);

at least one locking means (16) rigidly supported in said container adjacent said at least one extractable casing (3), said at least one locking means (16) having a locking member active on said at least one fitting length (12) outside and spaced from said coupling elements (22, 23) for locking said at least one fitting length (12) in a locking position wherein said at least one extractable casing (3) is in said work position and said coupling elements (22, 23) are in said engagement position;

said at least one locking means (16) being operatively connected with said electronic control and operation means (7) and being actuated by said electronic control and operation means (7) when said sensor means (19) signals detection of said engagement position of said coupling elements (22, 23).

2. An apparatus as claimed in claim 1, wherein said at least one extractable casing (3) has a front surface and said at least one fitting length (12) is fastened to said front surface.

3. An apparatus as claimed in claim 1, wherein said at least one fixed pipe (11) is fastened to an inner wall (2) of said container.

4. An apparatus as claimed in claim 1, wherein said at least one fitting length (12) has a tailpiece (15) rigid therewith and said locking means (16) are active on said tailpiece (15).

5. An apparatus as claimed in claim 4, wherein said tailpiece (15) is a tab extension **(15*a*) of said at least one fitting length (12)**.

6. An apparatus as claimed in claim 4, wherein said tailpiece (15) projects from said at least one fitting length (12) in said extraction direction **(3*a*)**.

7. An apparatus as claimed in claim 4, wherein said locking means (16) is rigidly supported by said at least one fixed pipe (11).

8. An apparatus as claimed in claim 4, wherein said locking means (16) has an electromechanically operated actuator and wherein said tailpiece (15) comprises at least one seating (17) for engagement with said actuator.

9. An apparatus as claimed in claim 1, further comprising signaling means (21) switched by said at least one sensor (19) for signaling said engagement position of said coupling elements (22, 23) and said work position of said at least one extractable casing (3).

10. An apparatus for dispensing smudging fluid in a banknote and valuables container internally including a plurality of superposed individually extractable casings (3) having a predetermined work position and extraction direction **(3*a*)**, the apparatus comprising:

at least one dispensing vessel (5) for said fluid;

channeling members (6) arranged between said at least one dispensing vessel (5) and said plurality of superposed extractable casings (3);

electronic control and operation means (7) for controllably supplying said smudging fluid from said at least one dispensing vessel (5) to said plurality of superposed extractable casings (3) in case of unauthorized access to said casings (3) in said work position;

wherein said channeling members (6) comprise:

a fixed pipe (11) extending vertically alongside said superposed extractable casings (3) and in fluid flow communication with said at least one dispensing vessel (5);

a plurality of fitting lengths (12) each rigid with a respective one of said superposed extractable casings (3) and projecting laterally from said casings (3) at a side thereof where said fixed pipe (11) is arranged;

a plurality of coupling means (13) each having a first coupling element (22) carried by a respective one of said fitting lengths (12) and in fluid flow communication with a respective one of said extractable casings (3), and a second coupling element (23) carried by said fixed pipe (11) and in fluid flow communication with said fixed pipe (11);

said first and second coupling elements (22, 23) of each of said coupling means (13) extending in said extraction direction (3*a*) sideways of said superposed extractable casings (3) and being movable between an engagement position and a disengagement position, whereby removal of said superposed extractable casings (3) from said work position causes mutual disengagement of the corresponding of said coupling elements (22, 23) and positioning of said superposed extractable casings (3) into said work position causes mutual engagement of the corresponding of said coupling elements (22, 23);

and further comprising:

a plurality of sensor means (19) each associated with a respective one of said coupling means (13) for detecting said engagement position of the corresponding of said coupling elements (22, 23), said sensor means (19) being operatively connected with said electronic control and operation means (7);

a plurality of locking means (16) rigidly supported in said container adjacent said superposed extractable casings (3), said locking means (16) having each a respective locking member active on a respective one of said fitting lengths (12) outside and spaced from a respective of said coupling elements (22, 23) for locking a respective one of said fitting lengths (12) in a respective locking position wherein a respective one of said superposed extractable casings (3) is in said work position and a respective one of said coupling elements (22, 23) is in said engagement position;

said locking means (16) being operatively connected with said electronic control and operation means (7) and being selectively actuated by said electronic control and operation means (7) when the respective of said sensor means (19) signal detection of said engagement position of the respective of said coupling elements (22, 23).

11. An apparatus as claimed in claim 10, wherein said fitting lengths (12) and said fixed pipe (11) extend substantially perpendicularly to each other and to said extraction direction (3*a*).

12. An apparatus for dispensing smudging fluid in a banknote and valuable container internally including at least one extractable casing (3) having a predetermined work position and extraction direction (3*a*), the apparatus comprising:

at least one dispensing vessel (5) for said fluid;

channeling members (6) arranged between said at least one dispensing vessel (5) and said at least one extractable casing (3);

electronic control and operation means (7) for controllably supplying said smudging fluid from said at least one dispensing vessel (5) to said at least one extractable casing (3) in case of disallowed access to said at least one extractable casing (3) in said work position;

wherein said channeling members (6) comprise:

at least one fixed pipe (11) arranged adjacent to said at least one extractable casing (3) sideways thereof and in fluid flow communication with said at least one dispensing vessel (5);

at least one fitting length (12) rigid with said at least one extractable casing (3) and projecting laterally from said at least one extractable casing (3) at a side thereof where said at least one fixed pipe (11) is arranged;

at least one coupling means (13) between said at least one fitting length (12) and said at least one fixed pipe (11), said at least one coupling means (13) comprising a first coupling element (22) carried by said at least one fitting length (12) and in fluid flow communication with said at least one extractable casing (3), and a second coupling element (23) carried by said at least one fixed pipe (11) and in fluid flow communication with said at least one fixed pipe (11);

said first and second coupling elements (22, 23) extending in said extraction direction (3*a*) sideways of said at least one extractable casing (3) and being movable between an engagement position and a disengagement position, whereby removal of said at least one extractable casing (3) from said work position causes mutual disengagement of said coupling elements (22, 23) and positioning of said at least one extractable casing (3) into said work position causes mutual engagement of said coupling elements (22, 23);

and wherein said coupling means (13) externally support at least one sleeve member (24) defining at least one holding chamber (24*a*) for a jet of said smudging fluid.

13. An apparatus as claimed in claim 12, wherein said coupling elements (22, 23) comprise a male coupling element (22) and a female coupling element (23), said female coupling element (23) internally having at least one valve element (23*a*) for preventing passage of said smudging fluid in said disengagement position of said coupling elements (22, 23), and wherein said valve element (23*a*) is arranged to be deactivated in a priority manner when said coupling elements (22, 23) are brought into said engagement position.

14. An apparatus as claimed in claim 13, wherein said holding chamber (24*a*) is elastically and sealingly engaged between said coupling elements (22, 23) when said valve element (23*a*) is deactivated.

* * * * *